US006735964B2

(12) United States Patent
Palmer et al.

(10) Patent No.: US 6,735,964 B2
(45) Date of Patent: May 18, 2004

(54) AIR CONDITIONING SYSTEM WITH REFRIGERANT CHARGE MANAGEMENT

(75) Inventors: John Michael Palmer, Cicero, NY (US); Mark Joseph Perkovich, Syracuse, NY (US); Bradley Odum, Manchester, TN (US)

(73) Assignee: Carrier Corporation, Syracuse, NY (US)

( * ) Notice: Subject to any disclaimer, the term of this patent is extended or adjusted under 35 U.S.C. 154(b) by 24 days.

(21) Appl. No.: 10/163,238

(22) Filed: Jun. 5, 2002

(65) Prior Publication Data

US 2003/0226367 A1 Dec. 11, 2003

(51) Int. Cl.[7] ..... F25B 45/00
(52) U.S. Cl. ..... 62/149; 62/292
(58) Field of Search ..... 62/186, 160, 176.6, 62/188, 177, 178, 149

(56) References Cited

U.S. PATENT DOCUMENTS

| | | | | |
|---|---|---|---|---|
| 4,620,423 A | | 11/1986 | Hopkinson et al. | |
| 4,620,424 A | * | 11/1986 | Tanaka et al. | 62/222 |
| 4,685,309 A | * | 8/1987 | Behr | 62/212 |
| 4,771,610 A | | 9/1988 | Nakashima et al. | |
| 5,142,877 A | | 9/1992 | Shimizu | |
| 5,161,388 A | | 11/1992 | Fujita et al. | |
| 5,263,333 A | | 11/1993 | Kubo et al. | |
| 5,303,561 A | * | 4/1994 | Bahel et al. | 62/186 |
| 5,768,903 A | * | 6/1998 | Sekigami et al. | 62/196.2 |
| 6,008,733 A | * | 12/1999 | Okano et al. | 380/825.06 |
| 6,024,547 A | * | 2/2000 | Nagae | 418/11 |
| 6,026,654 A | | 2/2000 | Park | |
| 6,354,097 B1 | * | 3/2002 | Schuster | 62/186 |
| 6,508,072 B1 | * | 1/2003 | Kanazawa et al. | 62/228.4 |

OTHER PUBLICATIONS

PCT, International Search Report, Oct. 16, 2003.

* cited by examiner

*Primary Examiner*—Melvin Jones
(74) *Attorney, Agent, or Firm*—Carlson, Gaskey & Olds

(57) ABSTRACT

An air conditioning system includes an outdoor unit and multiple indoor units. Each of the indoor units has its own coil assembly and fan and is dedicated to heating a particular area within a building, for example. Not all of the indoor units operate at the same time. Managing the refrigerant charge level within the active part of the system includes controlling an amount of refrigerant flow through the inactive indoor units. When the active part of the system does not have an adequate charge, an increased return flow from the inactive indoor units to the outdoor unit serves to increase the charge. Under circumstances where there is an overcharge in the active part of the system, the inactive indoor units are effectively used as storage for excess refrigerant on a temporary basis.

12 Claims, 1 Drawing Sheet

AIR CONDITIONING SYSTEM WITH REFRIGERANT CHARGE MANAGEMENT

BACKGROUND OF THE INVENTION

This invention generally relates to air conditioning systems that provide a heating function. More particularly, this invention relates to air conditioning systems having multiple indoor units in fluid communication with an outdoor unit for providing heat to a plurality of rooms or sections within a building.

Building air conditioning systems take a variety of forms. Most systems have an outdoor unit with a compressor and a coil assembly. Indoor units may be a single unit having a fan assembly and a coil assembly. Other systems have multiple indoor units, each with their own fan and coil assemblies.

Some air conditioning systems are capable of providing cooling during warm temperatures and heat during cooler outdoor temperatures. When multiple indoor unit systems ("multiplex systems") provide a heating function, it is desirable to control the amount of refrigerant charge within the system. Under some circumstances, not all of the indoor units need to operate to adequately heat the various portions of a building and, therefore, part of the overall system is inactive. Under such circumstances, it is possible for the level of refrigerant charge to become undesirably high or undesirably low within the active portion of the system. The system operation may be impaired when there is too much or too little refrigerant within the active part of the system (i.e., that part of the system including the indoor units that are currently heating). When there is too much refrigerant within the active part of the system, excessively high discharge pressures may occur. When there is too little refrigerant in the active part of the system, there is typically a loss of heating capacity and the possibility for increased ice formation on the coil of the outdoor unit.

One attempt at managing refrigerant charge in the active part of such a system is to include shutoff valves upstream of the indoor units. When a particular indoor unit is not required to be active, the shutoff valve closes off refrigerant flow from the outdoor unit to the inactive indoor unit or units. While this approach is useful, it includes the shortcoming of requiring additional charge up time at the indoor units when they are eventually needed for heating. Another drawback of this approach is that the reduced flow through the overall system increases the pressure in the active lines and causes hotter air to be discharged by the active indoor units, which may provide uneven heating within a building space and inefficient system operation.

There is a need for a more efficient refrigerant charge management approach within multiplex air conditioning systems that provide heat to a building space. This invention addresses that need while avoiding the shortcomings and drawbacks of prior approaches.

SUMMARY OF THE INVENTION

In general terms, this invention is a method and system for controlling the level of refrigerant charge within an air conditioning system having an outdoor unit and multiple indoor units where the indoor units are individually controllable so that not all of them necessarily are active at the same time.

A system designed according to this invention includes an outdoor unit having a compressor and a coil assembly. A plurality of indoor units are located within a building, each including its own fan and coil assembly. Supply and return lines connect the outdoor unit to the indoor units. A flow control device controls the amount of return fluid flow from the indoor units to the outdoor unit. A controller controls the flow control device to selectively vary the amount of refrigerant flowing downstream from any inactive indoor units so that the overall refrigerant charge level in the active part of the system is controlled within desirable levels.

In one example, each of the return lines from the indoor units includes a modulating expansion valve. A controller controls each of the valves to control an amount of refrigerant fluid returning from the indoor units to the outdoor unit and the active part of the system.

A method of this invention includes determining when the refrigerant charge level in the active part of the system is outside of a desirable range. Refrigerant fluid is allowed to flow into all of the indoor units, even those that are inactive at any given time. The amount of fluid flow returning from the inactive units is controlled to thereby control the amount of refrigerant charge level in the active part of the system.

When the refrigerant charge in the active part of the system is too low, an increased return flow from the inactive units is permitted. When the refrigerant charge level in the active part of the system is too high, refrigerant fluid is effectively stored within the inactive units for at least some period of time.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
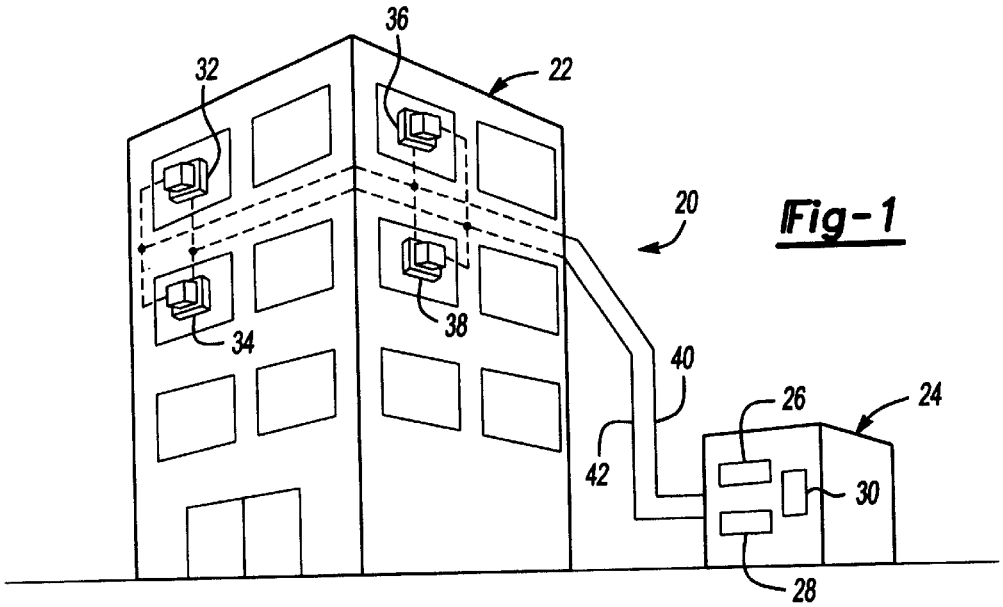
FIG. 1 schematically illustrates a system designed according to this invention.

An air conditioning system 20 provides temperature control within a building 22. An outdoor unit 24 includes a coil assembly 26 and a compressor 28. A controller 30 controls operation of the outdoor unit and monitors data regarding conditions of the overall system 20. For convenience in illustration, the controller 30 is schematically illustrated as part of the outdoor unit 24, however, the controller may be located at any suitable location within the building 22 provided that appropriate signal and power communication is available to the corresponding portions of the system 20.

A plurality of indoor units 32, 34, 36 and 38 each include their own fan and coil assembly. The indoor units are each responsible for customizing the temperature within a particular room or section of the building 22. Each of the indoor units communicates with the outdoor unit through a fluid supply line 40 and a return line 42.

The system 20 preferably is capable of providing cooling or heating to the areas within the building 22. The following description focuses on the system 20 operating in a heating mode.

Figure 2:
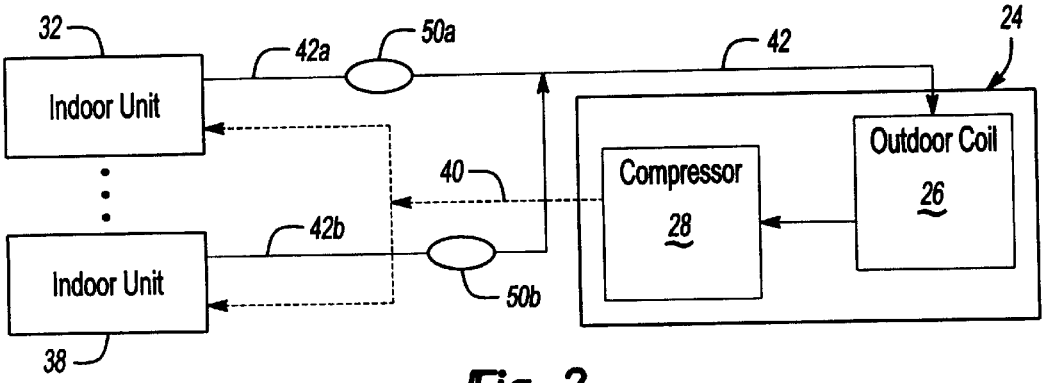
FIG. 2 schematically illustrates, in somewhat more detail, selected portions of the embodiment of FIG. 1.

As can be appreciated from FIG. 2, which shows indoor units 32 and 38 as examples of the plurality of indoor units, refrigerant flows from the compressor 28 through the supply line 40 to the indoor units. In this example, each of the indoor units has a dedicated return line 42, respectively. A modulating expansion valve 50A is provided on the return line 42A to selectively control the amount of refrigerant flowing downstream from the indoor unit 32 back to the outdoor unit 24. Similarly, a modulating expansion valve 50B is provided on the return line 42B. Although modulating expansion valves are used in this example, any other commercially available valve arrangement that includes selective flow control may be used in connection with a system designed according to this invention.

When the indoor unit 32 is active or on, providing heat to the associated portion of the building 22, at least that portion of the system that includes the indoor unit 32, the outdoor unit 24 and all fluid communication lines between them can be considered the "active" part of the system. Assuming that the portion of the building 22 that is heated by the indoor unit 38 is already at a desired temperature (controlled by a thermostat, for example) the indoor unit 38 is off or inactive (i.e., the fan is off). Therefore, the indoor unit 38 and the fluid communication lines between the outdoor unit 24 and the indoor unit 38 can be said to be the "inactive" part of the system 20.

Although the indoor unit 38 is off, some refrigerant preferably is allowed to flow into the unit 38. Therefore, some small, predetermined amount of refrigerant will condense in the inactive unit 38. Accordingly, the modulating expansion valve 50B preferably is set so that the same amount of refrigerant that condenses in the inactive unit 38 is returned to the active part of the system 20.

Whenever there is too much refrigerant in the active part of the system, it is desirable to store more refrigerant in the inactive unit 38. This is accomplished by reducing the flow allowed through the modulating expansion valve 50B. Under these circumstances, more refrigerant is allowed to remain in or be stored in the inactive unit 38 and the fluid temperature in the inactive unit 38 is well below the saturated discharge temperature of the compressor 28 (or active system). These operating conditions preferably are maintained until the charge level in the active part of the system comes within an acceptable range.

When the controller 30 determines that there is too little refrigerant in the active part of the system, the modulating expansion valve 50B preferably is opened to increase the amount of refrigerant flowing back to the active part of the system from the inactive unit 38.

Although only two of the indoor units are illustrated in FIG. 2, the flow of refrigerant from a plurality of inactive units can be selectively controlled in various sequences or manners to achieve the desired return rate of refrigerant to the active part of the system from the inactive units. The particular strategy for controlling the expansion valves 50 can be customized to suit the particular needs of a given situation. Those skilled in the art who have the benefit of this description will be able to realize what will work best for the particular system with which they are presented.

Figure 3:
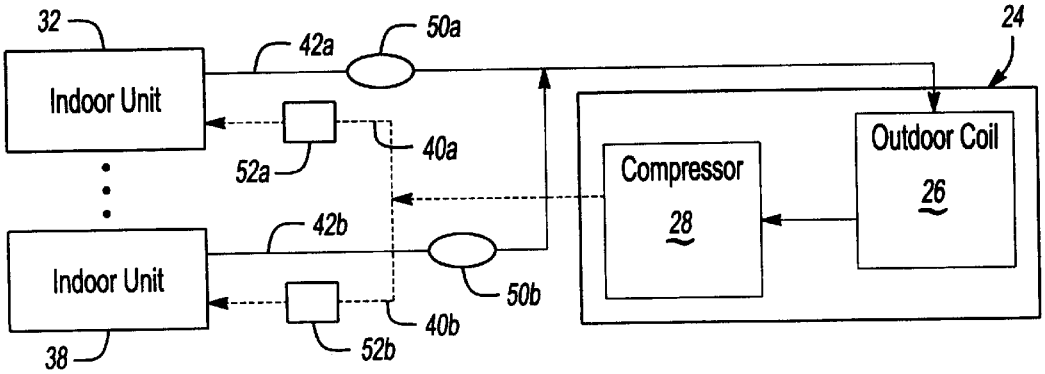
FIG. 3 illustrates an alternative arrangement to that shown in FIG. 2.

In the example of FIG. 3, a modification is included compared to that of FIG. 2. In the illustration of FIG. 3, solenoid valves 52A and 52B are provided on the supply lines 40A and 40B, respectively. The solenoid valves can be controlled to regulate the amount of fluid flowing into the inactive units. This may be useful, for example, in situations where one of the inactive units is at a saturation pressure while another inactive unit may still be able to store excess refrigerant from the active part of the system as needed.

One way to determine the refrigerant charge level within the system 20 includes monitoring the compressor suction superheat of the outdoor unit 24. This approach recognizes that when the modulating expansion valves in the return flow paths from the indoor units to the outdoor unit are opened to a fixed position while the system is in a heating mode, the indoor units will have a tendency to return more refrigerant to the outdoor coil than can be readily handled as the outdoor coil assembly operates as an evaporator. Therefore, the superheat leaving the outdoor coil, and entering the compressor, would be zero under these circumstances. The controller 30 preferably is programmed to recognize a sensor output (not illustrated) indicating temperature, pressure or both to identify such a situation.

Conversely, if the active part of the system is undercharged, the expansion devices will tend to feed less refrigerant to the outdoor coil assembly than it is capable of evaporating while the system 20 is in the heating mode. Under these circumstances, the superheat leaving the outdoor coil assembly will be too high. The compressor suction superheat therefore provides an indication of the amount of charge in the system. By suitably programming the controller 30 to recognize acceptable compressor suction superheat levels, the controller 30 can then determine when it is necessary to adjust one or more of the expansion devices 50 to increase or decrease the amount of refrigerant within the active part of the system.

Another approach for monitoring the refrigerant charge level in the active part of the system includes comparing the compressor discharge pressure with the refrigerant saturation pressure that corresponds to an indoor ambient temperature, which may be obtained from the indoor unit's air temperature sensor. In this example approach, the controller 30 is programmed to determine an overcharge condition when the discharge pressure from the compressor is excessively higher than the saturation pressure.

One aspect of the approach described in the previous paragraph is that it may include increasing the amount of refrigerant in the active part of the system when it appears that an undercharge situation exists. The additional refrigerant may be added until a predetermined minimum difference between the actual compressor discharge pressure and the refrigerant saturation pressure is established. The desired minimum difference between these pressures can be determined for various systems using testing or system simulation. Given this description, those skilled in the art will be able to determine the appropriate minimum differences for particular system configurations.

Another approach, which is the currently most preferred approach, is to monitor the superheat leaving the compressor of the outdoor unit 24. In this approach, the actual temperature leaving the compressor is measured and the pressure leaving the compressor is determined. One approach for determining the pressure leaving the compressor is to infer that pressure by gathering information from the coil temperatures of the indoor units. Another approach is to directly measure the pressure using a pressure transducer.

When the compressor discharge superheat is too high, the active part of the system is undercharged. Conversely, when the charge level in the active part of the system is too high, the discharge superheat will be too low. Under this approach, the discharge superheat should not be zero. An acceptable range within which the discharge superheat can be via such "inferred" methods for an acceptable charge level in the system will need to be determined for the particular configuration of a particular system. A typical acceptable range will be between 30° F. and 80° F. Approximately 50° F. is believed to be an optimum discharge superheat (at the points monitored) in one example system. Given this description, those skilled in the art will be able to find an acceptable range for a particular system configuration.

When utilizing one of the above mentioned approaches for monitoring the charge level within the active part of the system, it is preferred to use temperature determinations rather than pressure determinations under some circumstances, in part, because temperature sensors are less expensive than pressure sensors. This invention allows for a variety of strategies to monitor the refrigerant charge level within an active part of the system and to control that charge level by controlling the refrigerant flow through the inactive indoor units.

Given this description, those skilled in the art will be able to choose from among commercially available components to provide the various functions in this description and to realize the results provided by this invention. For example, the controller 30 may be a commercially available microprocessor suitably programmed to monitor the various temperatures or pressures and to provide the various control functions needed to manage the charge level of the refrigerant in the active part of this system consistent with this description.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an air conditioning system having at least one outdoor unit with an outdoor coil assembly and a plurality of indoor units that each include an indoor coil assembly where refrigerant fluid selectively flows between the outdoor unit and each of the indoor units, comprising the steps of:

activating the outdoor unit;

activating at least one of the indoor units;

determining whether a charge level of the refrigerant fluid in the portion of the system that includes the activated indoor unit is at a desirable level; and adjusting an amount of refrigerant fluid flow between the outdoor unit and at least one inactive indoor unit to thereby bring the charge level closer to the desirable level.

2. The method of claim 1, including decreasing the amount of return flow from at least the one inactive unit to the outdoor unit when the charge level is higher than the desirable level.

3. The method of claim 1, including increasing the amount of flow from at least the one indoor unit to the outdoor unit when the charge level is lower than the desirable level.

4. The method of claim 1, including determining the charge level by determining an amount of suction superheat of the outdoor unit.

5. The method of claim 1, including determining an amount of discharge superheat of the outdoor unit and determining whether the discharge superheat is within a predetermined acceptable range.

6. The method of claim 5, including determining the discharge superheat by determining a temperature of the refrigerant as it leaves the outdoor unit and determining the pressure of the refrigerant as it leaves the outdoor unit.

7. The method of claim 6, including determining the pressure of the refrigerant leaving the outdoor unit by determining a coil temperature in at least one of the indoor units.

8. The method of claim 1, including determining the charge level by determining a saturation temperature or pressure of the activated indoor unit and determining if a discharge temperature or pressure of the outdoor unit is within an acceptable range from the saturation temperature or pressure.

9. An air conditioning system, comprising:

an outdoor unit having a coil assembly and a compressor;

a plurality of indoor units in fluid communication with the outdoor unit, each indoor unit having a coil assembly;

at least one variable flow control device that controls an amount of refrigerant fluid flow from the indoor units to the outdoor unit; and a controller that controls the flow control device to regulate the amount of refrigerant flow from at least one of the indoor units when the at least one indoor unit is inactive to manage a refrigerant charge level in a portion of the system that includes at least one indoor unit that is active.

10. The system of claim 9, wherein the flow control device comprises a modulating expansion valve.

11. The system of claim 9, including fluid conduits downstream of each indoor unit between the indoor units and the outdoor unit and wherein the flow control device comprises a modulating expansion valve associated with each of the fluid conduits.

12. The system of claim 9, including fluid conduits upstream of each indoor unit between the indoor units and the outdoor unit and wherein the flow control device includes at least one valve associated with each upstream conduit that selectively control fluid flow upstream of the respective indoor units.

* * * * *